US006199035B1

(12) United States Patent
Lakaniemi et al.

(10) Patent No.: US 6,199,035 B1
(45) Date of Patent: Mar. 6, 2001

(54) PITCH-LAG ESTIMATION IN SPEECH CODING

(75) Inventors: Ari Lakaniemi, Tampere; Janne Vainio; Pasi Ojala, both of Sääksjärvi; Petri Haavisto, Tampere, all of (FI)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/073,697

(22) Filed: May 6, 1998

(30) Foreign Application Priority Data

May 7, 1997 (FI) ..... 971976
Mar. 5, 1998 (FI) ..... 980502

(51) Int. Cl.[7] ..... G10L 11/04
(52) U.S. Cl. ..... 704/207; 704/217
(58) Field of Search ..... 704/207, 208, 704/217

(56) References Cited

U.S. PATENT DOCUMENTS

| | | | |
|---|---|---|---|
| 4,486,900 | 12/1984 | Cox et al. | 381/38 |
| 4,969,192 | 11/1990 | Chen et al. | 381/31 |
| 5,179,594 | 1/1993 | Yip et al. | 381/40 |
| 5,327,520 | 7/1994 | Chen | 395/2.28 |
| 5,339,384 * | 8/1994 | Chen | 704/211 |
| 5,444,816 | 8/1995 | Adoul et al. | 395/2.28 |
| 5,483,668 | 1/1996 | Malkamaki et al. | 455/33.2 |
| 5,579,433 | 11/1996 | Jarvinen | 395/228 |
| 5,664,053 | 9/1997 | Laflamme et al. | 704/219 |
| 5,742,733 | 4/1998 | Jarvinen | 395/2.29 |

FOREIGN PATENT DOCUMENTS

| | | |
|---|---|---|
| 0 628 947 A1 | 12/1994 | (EP) . |
| 0 666 557 A2 | 8/1995 | (EP) . |
| 0 745 971 A2 | 12/1996 | (EP) . |
| 0 747 882 A2 | 12/1996 | (EP) . |

OTHER PUBLICATIONS

ETSI ETS 300 726 GSM "Digital Cellular Telecommunications Sytem; Enhanced Full Rate (EFR) Speech Transcoding" (GSM 06.60).
Knodoz "Digital Speech" 1994, Wiley, 134.*

* cited by examiner

*Primary Examiner*—David Hudspeth
*Assistant Examiner*—Harold Zintel
(74) *Attorney, Agent, or Firm*—Perman & Green, LLP

(57) ABSTRACT

A method of speech coding a sampled speech signal using long term prediction (LTP). A LTP pitch-lag parameter is determined for each frame of the speech signal by first determining the autocorrelation function for the frame within the signal, between predefined maximum and minimum delays. The autocorrelation function is then weighted to emphasize the function for delays in the neighborhood of the pitch-lag parameter determined for the most recent voiced frame. The maximum value for the weighted autocorrelation function is then found and identified as the pitch-lag parameter for the frame.

23 Claims, 4 Drawing Sheets

PITCH-LAG ESTIMATION IN SPEECH CODING

FIELD OF THE INVENTION

The present invention relates to speech coding and is applicable in particular to methods and apparatus for speech coding which use a long term prediction (LTP) parameter.

BACKGROUND OF THE INVENTION

Speech coding is used in many communications applications where it is desirable to compress an audio speech signal to reduce the quantity of data to be transmitted, processed, or stored. In particular, speech coding is applied widely in cellular telephone networks where mobile phones and communicating base controller stations are provided with so called "audio codecs" which perform coding and decoding on speech signals. Data compression by speech coding in cellular telephone networks is made necessary by the need to maximise network call capacity.

Modern speech codecs typically operate by processing speech signals in short segments called frames. In the case of the European digital cellular telephone system known as GSM (defined by the European Telecommunications Standards Institute—ETSI—specification 06.60), the length of each such frame is 20 ms, corresponding to 160 samples of speech at an 8 kHz sampling frequency. At the transmitting station, each speech frame is analysed by a speech encoder to extract a set of coding parameters for transmission to the receiving station. At the receiving station, a decoder produces synthesised speech frames based on the received parameters. A typical set of extracted coding parameters includes spectral parameters (known as LPC parameters) used in short term prediction of the signal, parameters used for long term prediction (known as LTP parameters) of the signal, various gain parameters, excitation parameters, and codebook vectors.

FIG. 1 shows schematically the encoder of a so-called CELP codec (substantially identical CELP codecs are provided at both the mobile stations and at the base controller stations). Each frame of a received sampled speech signal s(n), where n indicates the sample number, is first analysed by a short term prediction unit 1 to determine the LPC parameters for the frame. These parameters are supplied to a multiplexer 2 which combines the coding parameters for transmission over the air-interface. The residual signal r(n) from the short term prediction unit 1, i.e. the speech frame after removal of the short term redundancy, is then supplied to a long term prediction unit 3 which determines the LTP parameters. These parameters are in turn provided to the multiplexer 2.

The encoder comprises a LTP synthesis filter 4 and a LPC synthesis filter 5 which receive respectively the LTP and LPC parameters. These filters introduce the short term and long term redundancies into a signal c(n), produced using a codebook 6, to generate a synthesised speech signal ss(n). The synthesised speech signal is compared at a comparator 7 with the actual speech signal s(n), frame by frame, to produce an error signal e(n). After weighting the error signal with a weighting filter 8 (which emphasises the 'formants' of the signal in a known manner), the signal is applied to a codebook search unit 9. The search unit 9 conducts a search of the codebook 6 for each frame in order to identify that entry in the codebook which most closely matches (after LTP and LPC filtering and multiplication by a gain g at a multiplier 10) the actual speech frame, i.e. to determine the signal c(n) which minimises the error signal e(n). The vector identifying the best matching entry is provided to the multiplexer 2 for transmission over the air-interface as part of an encoded speech signal t(n).

FIG. 2 shows schematically a decoder of a CELP codec. The received encoded signal t(n) is demultiplexed by a demultiplexer 11 into the separate coding parameters. The codebook vectors are applied to a codebook 12, identical to the codebook 6 at the encoder, to extract a stream of codebook entries c(n). The signal c(n) is then multiplied by the received gain g at a multiplier 13 before applying the signal to a LTP synthesis filter 14 and a LPC synthesis filter 15 arranged in series. The LTP and LPC filters receive the associated parameters from the transmission channel and reintroduce the short and long term redundancies into the signal to produce, at the output, a synthesised speech signal ss(n).

The LTP parameters include the so called pitch-lag parameter which describes the fundamental frequency of the speech signal. The determination of the pitch-lag for a current frame of the residual signal is carried out in two stages. Firstly, an open-loop search is conducted, involving a relatively coarse search of the residual signal, subject to a predefined maximum and minimum delay, for a portion of the signal which best matches the current frame. A closed-loop search is then conducted over the already synthesised signal. The closed-loop search is conducted over a small range of delays in the neighbourhood of the open-loop estimate of pitch-lag. It is important to note that if a mistake is made in the open-loop search, the mistake cannot be corrected in the closed-loop search.

In early known codecs, the open-loop LTP analysis determines the pitch-lag for a given frame of the residual signal by determining the autocorrelation function of the frame within the residual speech signal, i.e.:

$$\hat{R}(d) = \sum_{n=0}^{N-1} r(n-d)r(n) \quad d = d_L, \ldots, d_H$$

where d is the delay, r(n) is the residual signal, and $d_L$ and $d_H$ are the delay search limits. N is the length of the frame. The pitch-lag $d_{p1}$ can then be identified as the delay $d_{max}$ which corresponds to the maximum of the autocorrelation function $\hat{R}(d)$. This is illustrated in FIG. 3.

In such codecs however, there is a possibility that the maximum of the autocorrelation function corresponds to a multiple or sub-multiple of the pitch-lag and that the estimated pitch-lag will therefore not be correct. EP0628947 addresses this problem by applying a weighting function w(d) to the autocorrelation function $\hat{R}(d)$, i.e.

$$\hat{R}_w(d) = w(d)\sum_{n=0}^{N-1} r(n-d)r(n)$$

where the weighting function has the following form:

$$w(d)=d^{\log_2 K}$$

K is a tuning parameter which is set at a value low enough to reduce the probability of obtaining a maximum for $\hat{R}_w(d)$ at a multiple of the pitch-lag but at the same time high enough to exclude sub-multiples of the pitch-lag.

EP0628947 also proposes taking into account pitch lags determined for previous frames in determining the pitch lag for a current frame. More particularly, frames are classified as either 'voiced' or 'unvoiced' and, for a current frame, a search is conducted for the maximum in the neighbourhood of the pitch lag determined for the most recent voiced frame. If the overall maximum of $\hat{R}_w(d)$ lies outside of this neighbourhood, and does not exceed the maximum within the neighbourhood by a predetermined factor (3/2), then the neighbourhood maximum is identified as corresponding to the pitch lag. In this way, continuity in the pitch lag estimate is maintained, reducing the possibility of spurious changes in pitch-lag.

SUMMARY OF THE INVENTION

According to a first aspect of the present invention there is provided a method of speech coding a sampled signal using a pitch-lag parameter for each of a series of frames of the signal, the method comprising for each frame:

determining the autocorrelation function for the frame within the signal, between predefined maximum and minimum delays;

weighting the autocorrelation function to emphasise the function for delays in the neighbourhood of the pitch-lag parameter determined for a previous frame; and identifying the delay corresponding to the maximum of the weighted autocorrelation function as the pitch-lag parameter for the frame.

Preferably, said sampled signal is a residual signal which is obtained from an audio signal by substantially removing short term redundancy from the audio signal, Alternatively, the sampled signal may be an audio signal.

Preferably, said weighting is achieved by combining the autocorrelation function with a weighting function having the form:

$$w(d)=(=T_{prev}-d=+d_L)^{\log_2 K_{nw}}$$

where $T_{prev}$ is a pitch-lag parameter determined on the basis of one or more previous frames, $d_L$ is said minimum delay, and $K_{nw}$ is a tuning parameter defining the neighbourhood weighting. Additionally, the weighting function may emphasise the autocorrelation function for shorter delays relative to longer delays. In this case, a modified weighting function is used:

$$w(d)=(=T_{prev}-d=+d_L)^{\log_2 K_{nw}} d^{\log_2 K_w}$$

where $K_w$ is a further tuning parameter.

In certain embodiments of the invention, $T_{prev}$ is the pitch lag of one previous frame $T_{old}$. In other embodiments however, $T_{prev}$ is derived from the pitch lags of a number of previous frames. In particular, $T_{prev}$ may correspond to the median value of the pitch lags of a predetermined number of previous frames. A further weighting may be applied which is inversely proportion to the standard deviation of the n pitch lags used to determine said median value. Using this latter approach, it is possible to reduce the impact of erroneous pitch lag values on the weighting of the autocorrelation function.

Preferably, the method comprises classifying said frames into voiced and non-voiced frames, wherein said previous frame(s) is/are the most recent voiced frame(s). Non-voiced frames may include unvoiced frames, and frames containing silence or background noise. More preferably, if said previous frame(s) is/are not the most recent frame(s), the weighting is reduced. In one embodiment, where a sequence of consecutive non-voiced frames is received, the weighting is reduced substantially in proportion to the number of frames in the sequence. For the weighting function $w_n(d)$ given in the preceding paragraph, the tuning parameter $K_{nw}$ may be modified such that:

$$w_d(d)=(=T_{prev}-d=+d_L)^{\log_2 K_{nwA}} \sim d^{\log_2 K_w}$$

where A is a further tuning factor which is increased following receipt of each frame in a sequence of consecutive non-voiced frames. The weighting is restored to its maximum value for the next voiced frame by returning A to its minimum value. The value of A may be similarly increased following receipt of a voiced frame which gives rise to an open-loop gain which is less than a predefined threshold gain.

According to a second aspect of the present invention there is provided apparatus for speech coding a sampled signal using a pitch-lag parameter for each of a series of frames of the signal, the apparatus comprising:

means for determining for each frame the autocorrelation function of the frame within the signal between predetermined maximum and minimum delays;

weighting means for weighting the autocorrelation function to emphasise the function for delays in the neighbourhood of the pitch-lag parameter determined for a previous frame; and means for identifying the delay corresponding to the maximum of the weighted autocorrelation function as the pitch-lag parameter for the frame.

According to a third aspect of the present invention there is provided a mobile communications device comprising the apparatus of the above second aspect of the present invention.

According to fourth aspect of the present invention there is provided a cellular telephone network comprising a base controller station having apparatus according to the above second aspect of the present invention.

DETAILED DESCRIPTION

Figure 1:
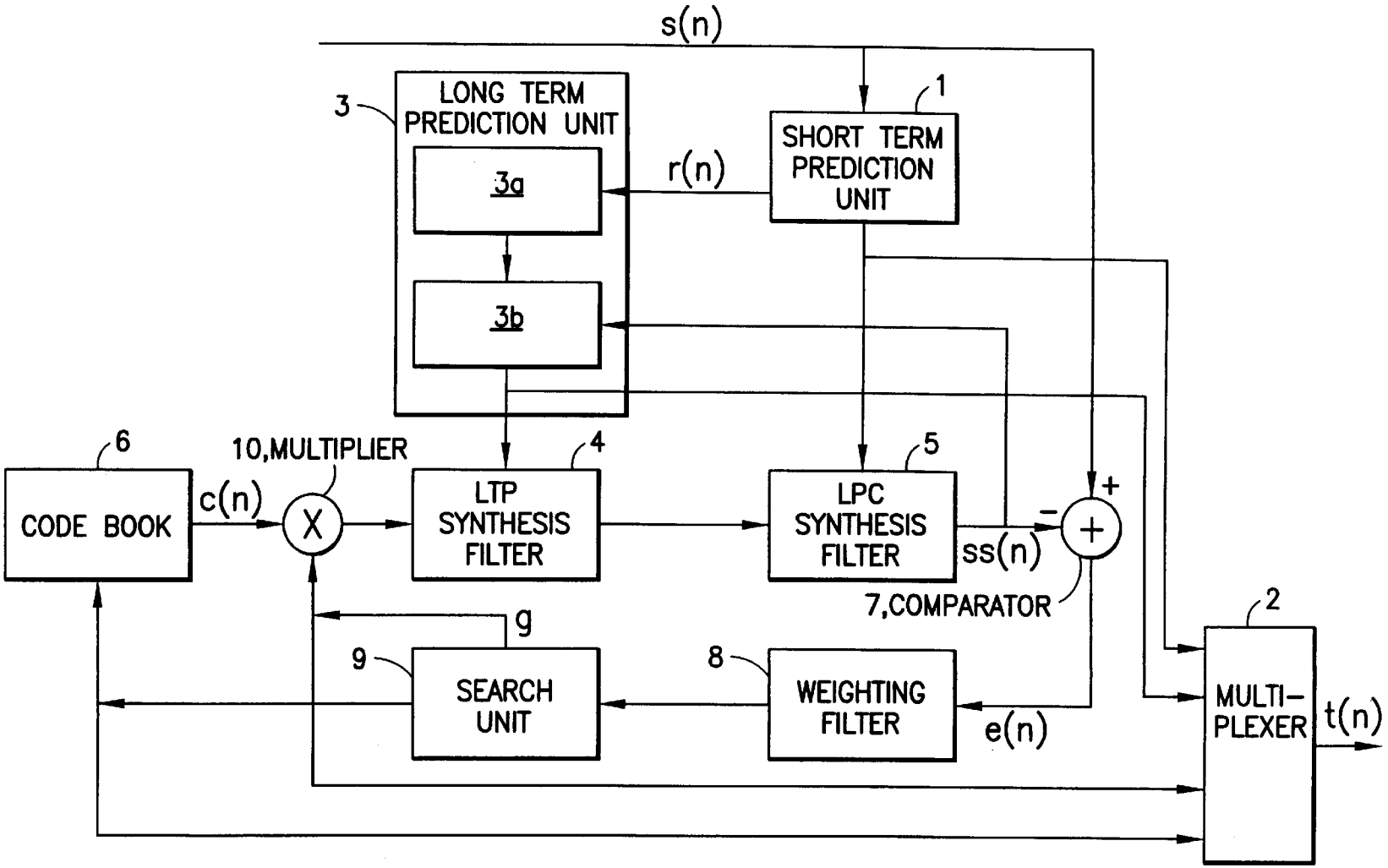
FIG. 1 PRIOR ART
FIG. 1 shows schematically a CELP speech encoder.
Figure 2:
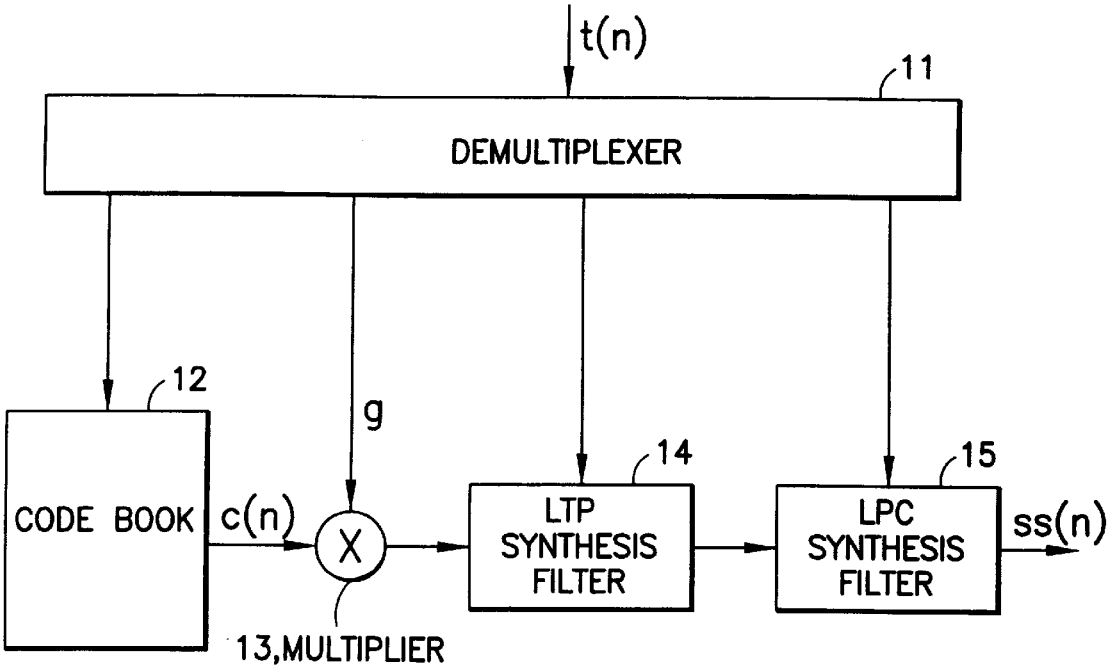
FIG.2 PRIOR ART
FIG. 2 shows schematically a CELP speech decoder.
Figure 3:
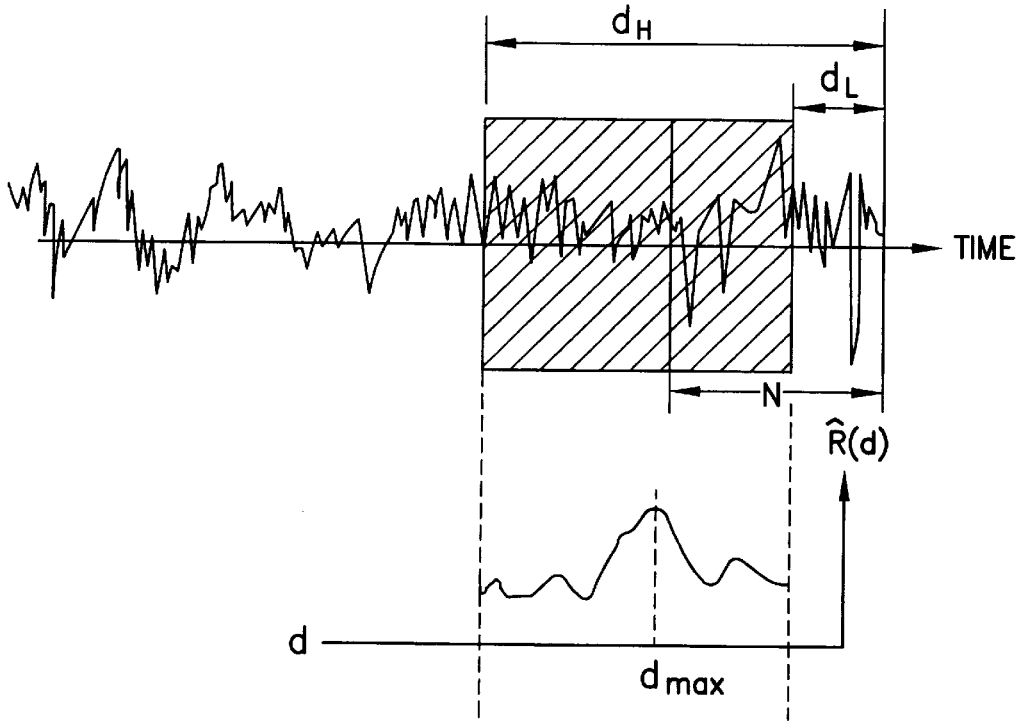
FIG. 3 illustrates a frame of a speech signal to be encoded and maximum and minimum delays used in determining the autocorrelation function for the frame.
Figure 4:
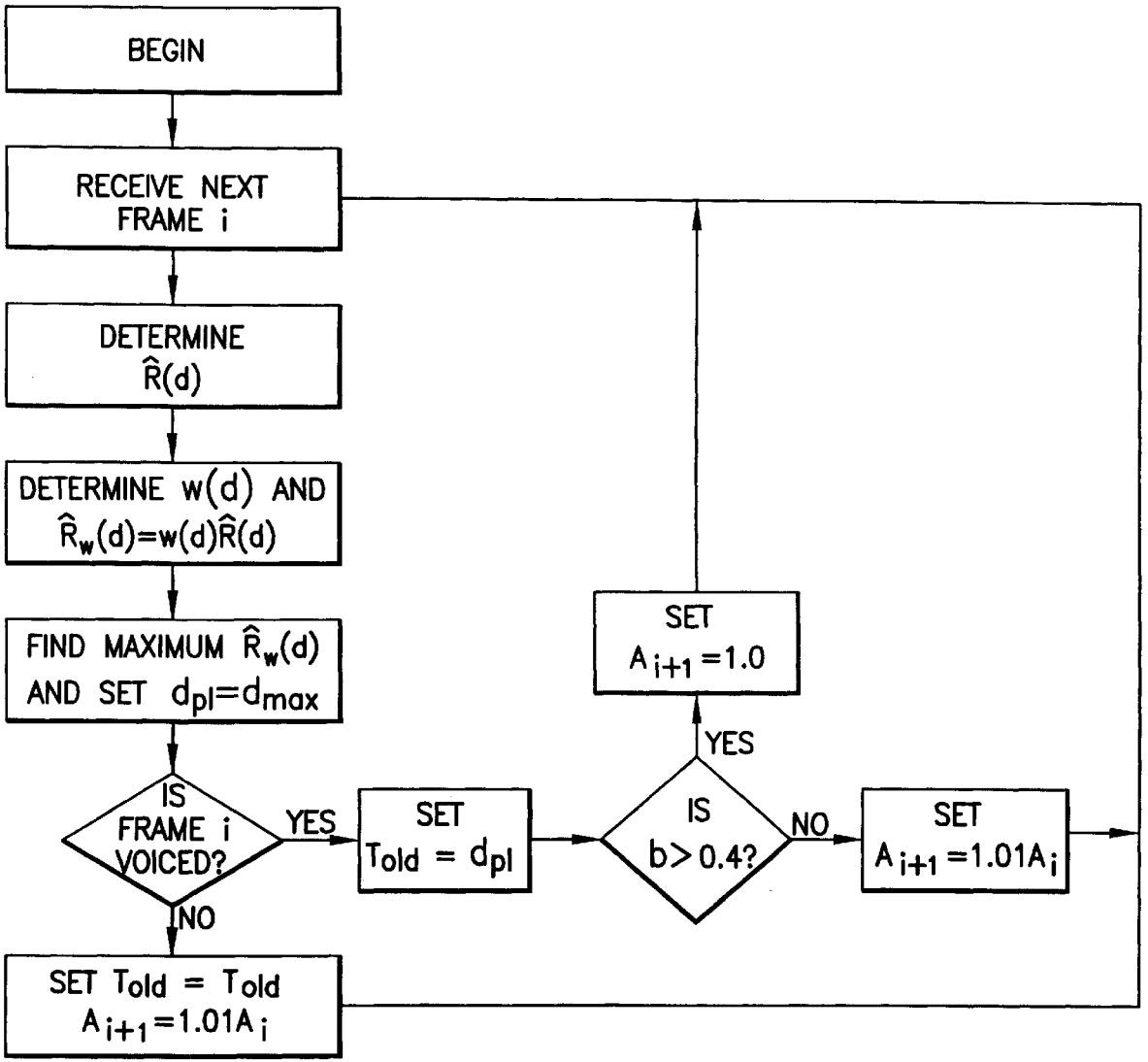
FIG. 4 is a flow diagram of the main steps of a speech encoding method according to an embodiment of the present invention.

There will now be described a method and apparatus for use in the open loop prediction of pitch-lag parameters for frames of a sampled speech signal. The main steps of the method are shown in the flow diagram of FIG. 4. It will be appreciated that the method and apparatus described can be incorporated into otherwise conventional speech codecs such as the CELP codec already described above with reference to FIG. 1.

A sampled speech signal to be encoded is divided into frames of a fixed length. As described above, upon receipt, a frame is first applied to a LPC prediction unit 1. Typically, open loop LTP prediction is then applied to the residual signal which is that part of the original speech signal which remains after LPC prediction has been applied and the short term redundancy of the signal extracted. This residual signal can be represented by r(n) where n indicates the sample number. The autocorrelation function is determined for a frame by:

$$\hat{R}_w(d) = w(d)\sum_{n=0}^{N-1} r(n-d)r(n) \quad d = d_L, \ldots, d_H \qquad \{1\}$$

where w(d) is a weighting function given by:

$$w(d)=(=T_{old}-d=+d_L)^{log_2 K_{nw}A} \sim d^{log_2 K_w} \qquad \{2\}$$

$T_{old}$ is the pitch lag determined for the most recently received, and processed, voiced frame and n, N, $d_L$, $d_H$, are identified above. $K_{nw}$ and K are tuning parameters typically having a value of 0.85. The additional tuning parameter A is discussed below.

After the open-loop LTP parameters are determined for a frame, the frame is classified as voiced or unvoiced (to enable feedback of the parameter $T_{old}$ for use in equation {2}). This classification can be done in a number of different ways. One suitable method is to determine the open-loop LTP gain b and to compare this with some predefined threshold gain, or more preferably an adaptive threshold gain $b_{thr}$ given by:

$$b_{thr}=(1-\alpha)K_b b+\alpha b_{thr-1} \qquad \{3\}$$

where $\alpha$ is a decay constant (0.995) and $K_b$ is a scale factor (0.15). The term $b_{thr-1}$ is the threshold gain determined for the immediately preceding frame. An alternative, or additional criteria for classifying a frame as either voiced or unvoiced, is to determine the 'zero crossing' rate of the residual signal within the frame. A relatively high rate of crossing indicates that the frame is unvoiced whilst a low crossing rate indicates that the frame is voiced. A suitable threshold is ¾ of the frame length N.

A further alternative or additional criteria for classifying a frame as voiced or unvoiced is to consider the rate at which the pitch lag varies. If the pitch lag determined for the frame deviates significantly from an 'average' pitch lag determined for a recent set of frames, then the frame can be classified as unvoiced. If only a relatively small deviation exists, then the frame can be classified as voiced.

The weighting function $w_n(d)$ given by {2} comprises a first term $(=T_{old}-d=+d_L)^{log_2 K_{nw}A}$ which causes the weighted autocorrelation function $\hat{R}_w(d)$ to be emphasised in the neighbourhood of the old pitch-lag $T_{old}$. The second term on the left hand side of equation {2}, $d^{log_2 K_w}$, causes small pitch-lag values to be emphasised. The combination of these two terms helps to significantly reduce the possibility of multiples or sub-multiples of the correct pitch-lag giving rise to the maximum of the weighted autocorrelation function.

If, after determining the pitch lag for a current frame i, that frame is classified as voiced, and the open loop gain for the frame is determined to be greater than some threshold value (e.g. 0.4), the tuning factor A in equation {2} is set to 1 for the next frame (i+1). If however the current frame is classified as unvoiced, or the open loop gain is determined to be less than the threshold value, the tuning factor is modified as follows:

$$A_{i+1}=1.01A_i \qquad \{4\}$$

The tuning factor A may be modified according to equation {4} for each of a series of consecutive unvoiced frames (or voiced frames where the open loop gain is less than the threshold). However, it is preferred that equation {4} is applied only after a predefined number of consecutive unvoiced frames are received, for example after every set of three consecutive unvoiced frames. The neighbourhood weighting factor $K_{nw}$ is typically set to 0.85 where the upper limit for the combined weighting $K_{nw}A$ is 1.0 so that in the limit the weighting is uniform across all delays $d=d_L$ to $d_H$.

Alternatively, only a predefined number of weighting functions w(d) may be used, for example three. Each function has assigned thereto a threshold level, and a particular one of the functions is selected when an adaptive term, such as is defined in {4}, exceeds that threshold level. An advantage of defining a limited number of weighting functions is that the functions defined can be stored in memory. It is not therefore necessary to recalculate the weighting function for each new frame.

Figure 5:
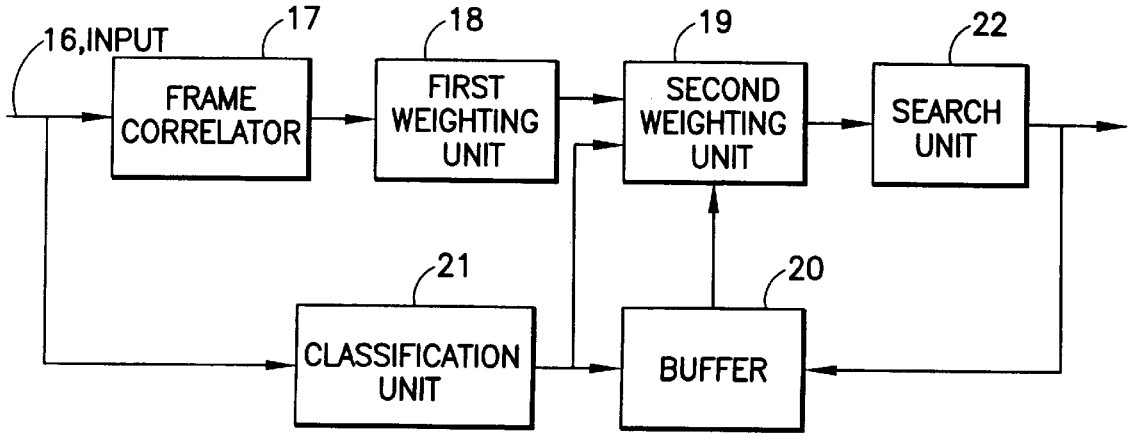
FIG. 5 shows schematically a system for implementing the method of FIG. 4.

A simplified system for implementing the method described above is illustrated schematically in FIG. 5, where the input 16 to the system is the residual signal provided by the LPC prediction unit 1. This residual signal 16 is provided to a frame correlator 17 which generates the correlation function for each frame of the residual signal. The correlation function for each frame is applied to a first weighting unit 18 which weights the correlation function according to the second term in equation {2}, i.e. $d^{log_2 K_w}$. The weighted function is then applied to a second weighting unit 19 which additionally weights the correlation function according to the first term of equation {2}, $(=T_{old}-d=+d_L)^{log_2 K_{nw}A}$. The parameter $T_{old}$ is held in a buffer 20 which is updated using the system output only if the classification unit 21 classifies the current frame as voiced. The weighted correlation function is applied to a search unit 22 which identifies the maximum of the weighted function and determines therefrom the pitch lag of the current frame.

It will be appreciated by the skilled person that various modifications may be made to the embodiments described above without departing from the scope of the present invention. In particular, in order to prevent an erroneous pitch lag estimation, obtained for the most recent voiced frame, upsetting a current estimation to too great an extent, the buffer 20 of FIG. 5 may be arranged to store the pitch lags estimated for the most recent n voiced frames, where n may be for example 4. The weighting function applied by the weighting unit 19 is modified by replacing the parameter $T_{old}$ with a parameter $T_{med}$ which is the median value of the n buffered pitch lags.

In a further modification, the weighting applied in the unit 19 is related to the standard deviation of the n pitch lag values stored in the buffer 20. This has the effect of emphasising the weighting in the neighbourhood of the median pitch lag when the n buffered pitch lags vary little, and conversely de-emphasising the weighting when the n pitch lags vary to a relatively large extent. For example, three weighting functions may be employed as follows:

$$w_d(d) = \begin{cases} (|T_{med}-d|+d_L)^{\log_2 K_{m1}}, & std < Th_1 \\ (|T_{med}-d|+d_L)^{\log_2 K_{m2}}, & Th_1 \le std < Th_2 \\ 1, & std \ge Th_2 \end{cases} \qquad \{5\}$$

where $K_{m1}$, $K_{m2}$, $Th_1$, and $Th_2$ are tuning parameters equal to, for example, 0.75, 0.95, 2, and 6 respectively. In order to accomodate the larger variations in standard deviation which occur with larger pitch lags, the thresholds $Th_1$, and $Th_2$ in equation {5} may be proportional to the median pitch lag $T_{med}$.

What is claimed is:

1. A method of speech coding a sampled signal using a pitch-lag parameter for each of a series of frames of the signal, the method comprising for each frame:

determining the autocorrelation function for the frame within the signal, between predefined maximum and minimum delays;

weighting the autocorrelation function to emphasise the function for delays in the neighborhood of the pitch-lag parameter determined for a previous frame; and identifying the delay corresponding to the maximum of the weighted autocorrelation function as the pitch-lag parameter for the frame.

2. A method according to claim 1, wherein said weighting additionally emphasizes shorter delays relative to longer delays.

3. A method according to claim 1 and comprising classifying said frames into voiced and non-voiced frames, wherein said previous frame(s) is/are the most recent voiced frame(s).

4. Apparatus for speech coding a sampled signal using a pitch-lag parameter for each of a series of frames of the signal, the apparatus comprising:

means for determining for each frame the autocorrelation function of the frame within the signal between predetermined maximum and minimum delays;

weighting means for weighting the autocorrelation function to emphasize the function for delays in the neighborhood of the pitch-lag parameter determined for a previous frame; and means for identifying the delay corresponding to the maximum of the weighted autocorrelation function as the pitch-lag parameter for the frame.

5. A mobile communications device comprising the apparatus of claim 4.

6. A cellular telephone network comprising a base controller station having apparatus according to the claim 4.

7. A method of speech coding a sampled signal using a pitch-lag parameter for each of a series of frames of the sampled signal, the method comprising for each frame:

determining an autocorrelation function for at least one frame within the series of frames within the sampled signal, between predefined maximum and minimum delays;

weighting the autocorrelation function to emphasize the autocorrelation function for delays in the neighborhood of a median value of a plurality of pitch-lag parameters determined for respective previous frames within the series of frames; and identifying a delay corresponding to the maximum of the weighted autocorrelation function as the pitch-lag parameter for the at least one frame.

8. A method according to claim 7, wherein said weighting additionally emphasizes shorter delays relative to longer delays.

9. A method according to claim 7, wherein the weighting function has the form:

$$W_d(d)=(=T_{med}-d=+d_L)^{\log_2 K_{nw}} d^{\log_2 K_{nw}}$$

where $T_{med}$ is the median value of a plurality of pitch lags determined for respective previous frames, $d_L$ is said minimum delay, and $K_{nw}$ is a tuning parameter defining the neighborhood weighting and said emphasis is provided by the factor:

$$d^{\log_2 K_w}$$

where $K_w$ is a further weighting parameter.

10. A method according to claim 7 and comprising classifying said frames into voiced and non-voiced frames, wherein said previous frame(s) is/are the most recent voiced frame(s).

11. Apparatus for speech coding a sampled signal using a pitch-lag parameter for each of a series of frames of the sampled signal, the apparatus comprising:

means for determining for at least one frame within the series of frames an autocorrelation function between predetermined maximum and minimum delays;

weighting means for weighting the autocorrelation function to emphasize the autocorrelation function for delays in the neighborhood of a median value of a plurality of pitch-lag parameters determined for respective previous frames; and means for identifying a delay corresponding to the maximum of the weighted autocorrelation function as the pitch-lag parameter for the at least one frame.

12. A mobile communications device comprising the apparatus of claim 11.

13. A cellular telephone network comprising a base controller station having apparatus according to the claim 11.

14. A method of speech coding a sampled signal using a pitch-lag parameter for each of a series of frames of the signal, the method comprising for each frame:

determining the autocorrelation function for the frame within the signal, between predefined maximum and minimum delays;

weighting the autocorrelation function with a weighting function to emphasize the function for delays in the neighborhood of the pitch-lag parameter determined for a previous frame, wherein the weighting function has the form:

$$W_d(d)=(=T_{old}-d=+d_L)^{\log_2 K_{nw}}$$

where $T_{old}$ is the pitch lag of said previous frame, $d_L$ is said minimum delay, and $K_{nw}$ is a tuning parameter defining the neighborhood weighting; and identifying the delay corresponding to the maximum of the weighted autocorrelation function as the pitch-lag parameter for the frame.

15. A method according to claim 14 and comprising classifying said frames into voiced and non-voiced frames, wherein said previous frame(s) is/are the most recent voiced frame(s), and wherein the tuning parameter $K_{nw}$ is replaced by a tuning parameter of:

$$K_{nw}A$$

where A is a further tuning factor which is increased following receipt of each frame, or of a predefined plurality of frames, in a sequence of consecutive non-voiced frames and which is restored to its minimum value for the next voiced frame.

16. A method of speech coding a sampled signal using a pitch-lag parameter for each of a series of frames of the sampled signal, the method comprising for each frame:

determining the autocorrelation function for the frame within the signal, between predefined maximum and minimum delays;

weighting the autocorrelation function to emphasize the function for delays in the neighborhood of the pitch-lag parameter determined for a previous frame, wherein the autocorrelation function is weighted to emphasize the function for delays in the neighborhood of the median value of a plurality of pitch lags determined for respective previous frames; and identifying the delay corresponding to the maximum of the weighted autocorrelation function as the pitch-lag parameter for the frame.

17. A method according to claim 16, wherein the weighting function has the form:

$$W_d(d)=(=T_{med}-d=+d_L)^{log_2 K_{nw}}$$

where $T_{med}$ is the median value of a plurality of pitch lags determined for respective previous frames, $d_L$ is said minimum delay, and $K_{nw}$ is a tuning parameter defining the neighborhood weighting.

18. A method according to claim 17, wherein the weighting function is modified by the inclusion of a factor which is inversely related to the standard deviation of said plurality of pitch lags.

19. A method according to claim 17, wherein the weighting function is modified by the inclusion of a factor which is inversely related to the standard deviation of said plurality of pitch lags.

20. A method according to claim 16, wherein the weighting function has the form:

$$W_d(d)=(=T_{med}-d=+d_L)^{log_2 K_{nw}} d^{log_2 K_{nw}}$$

where $T_{med}$ is the median value of a plurality of pitch lags determined for respective previous frames, $d_L$ is said minimum delay, and $K_{nw}$ is a tuning parameter defining the neighborhood weighting and said emphasis is provided by the factor:

$$d^{log_2 K_{nw}}.$$

21. A method of speech coding a sampled signal using a pitch-lag parameter for each of a series of frames of the signal, the method comprising for each frame:

classifying the frame into one of a voiced and a non-voiced frame;

determining the autocorrelation function for the frame within the signal, between predefined maximum and minimum delays;

weighting the autocorrelation function to emphasize the function for delays in the neighborhood of the pitch-lag parameter determined for a respective previous frame, wherein said previous frame is the most recent voiced frame; and identifying the delay corresponding to the maximum of the weighted autocorrelation function as the pitch-lag parameter for the frame, wherein, if said previous frame, or the most recent previous frame, is not the most recent frame, the weighting is reduced.

22. A method of speech coding a sampled signal using a pitch-lag parameter for each of a series of frames of the signal, the method comprising for each frame:

classifying the frame into one of a voiced and a non-voiced frame;

determining the autocorrelation function for the frame within the signal, between predefined maximum and minimum delays;

weighting the autocorrelation function to emphasize the function for delays in the neighborhood of the pitch-lag parameter determined for a respective previous frame, wherein said previous frame is the most recent voiced frame; and identifying the delay corresponding to the maximum of the weighted autocorrelation function as the pitch-lag parameter for the frame, wherein, after a sequence of consecutive non-voiced frames is received, the weighting is reduced, substantially in proportion to the number of frames in the sequence.

23. A method of speech coding a sampled signal using a pitch-lag parameter for each of a series of frames of the signal, the method comprising for each frame:

determining the autocorrelation function for the frame within the signal, between predefined maximum and minimum delays;

weighting the autocorrelation function with a weighting function to emphasize the function for delays in the neighborhood of the pitch-lag parameter determined on the basis of at least one previous frame, wherein the weighting function has the form:

$$W_d(d)=(=T_{prev}-d=+d_L)^{log_2 K_{nw}}$$

where $T_{prev}$ is the pitch lag determined on the basis of at least one previous frame, $d_L$ is said minimum delay, and $K_{nw}$ is a tuning parameter defining the neighborhood weighting; and identifying the delay corresponding to the maximum of the weighted autocorrelation function as the pitch-lag parameter for the frame.

* * * * *